US006017231A

United States Patent [19]

Yoshitsugu et al.

[11] Patent Number: 6,017,231

[45] Date of Patent: Jan. 25, 2000

[54] CARD EJECTING MECHANISM DRIVEN BY A MEMORY ALLOY WIRE

[75] Inventors: Koseki Yoshitsugu, Suwa; Hara Tomohisa, Kayano, both of Japan

[73] Assignee: Hon Hai Precision Ind. Co., Ltd., Taipei Hsien, Taiwan

[21] Appl. No.: 09/218,727

[22] Filed: Dec. 22, 1998

[51] Int. Cl.[7] ..... H01R 13/62

[52] U.S. Cl. ..... 439/159; 439/161

[58] Field of Search ..... 439/159, 161, 439/152, 155, 160; 361/754, 798, 727, 725, 737, 684, 686, 796, 801, 802

[56] References Cited

U.S. PATENT DOCUMENTS

| | | | |
|---|---|---|---|
| 4,821,147 | 4/1989 | Jacobs et al. | 361/388 |
| 5,466,166 | 11/1995 | Law et al. | 439/159 |
| 5,967,810 | 10/1999 | Spickler et al. | 439/159 |

*Primary Examiner*—Michael L. Gellner
*Assistant Examiner*—Barry M. L. Standig

[57] ABSTRACT

A mechanism for ejecting an electronic card inserted into a card connector is driven by applying an electrical current to a memory alloy wire to cause the wire to retract and the mechanism to move from a first position to a second position. Immediately after the mechanism reaches the second position, another card can be inserted into the connector without waiting for the wire to resume its original length.

12 Claims, 8 Drawing Sheets

CARD EJECTING MECHANISM DRIVEN BY A MEMORY ALLOY WIRE

BACKGROUND OF THE INVENTION

1. Field of the Invention

The present invention relates to a card connector, and particularly to a card connector having an improved card ejecting mechanism driven by a memory alloy wire.

2. The Prior Art

A card ejecting mechanism driven by a memory alloy wire to eject an electronic card inserted into a card connector has been disclosed in Japanese Patent Publication No. 8-236203. Referring to FIGS. 1 to 4 of the present application which are correspondent to FIGS. 3, 16, 17 and 5 of the Publication, a card connector has a card ejecting mechanism 9. The mechanism 9 has a drawer plate 92 and a card ejecting plate 90 connected together by a rivet 95. The drawer plate 92 has a right end pulled by a tension spring S1. The card ejecting plate 90 has a left end pulled by a compression tension S2. Particularly referring to FIGS. 1 and 2, when an electronic card 8 is inserted into the connector to reach its final position, the two plates 90, 92 are fixed in position by a front edge of a wing 68 of the card ejecting plate 90 engaging with a stop 93 of the connector. A wedge 94 having an inclined bottom face 941 is attached to a memory alloy wire 91. By the provision of the wedge 94 and the nature of the memory alloy wire 91 which retracts when applied with an electrical current, the engagement between the wing 68 and the stop 93 can be released to cause the card ejecting plate 90 to pivot and eject the inserted card 8, as explained below.

Referring to FIG. 2, the card ejecting plate 90 is at an upper position close to the drawer plate 92. When the wire 91 is applied with an electrical current to retract, as shown in FIG. 3, the wedge 94 moves toward the card ejecting plate 90 and the inclined face 941 pushes the wing 68 downward to cause it to disengage from the stop 93. Thus, the card ejecting plate 90 and the drawer plate 92 are free to pivot by the pulling force of the tension spring S1 to a position as shown in FIG. 4, in which the card 8 is ejected form the connector.

With the design of the prior art, a period of 6–8 seconds must elapse after the electrical current applied to the wire 91 is removed therefrom for the memory wire 91 to resume its original length. A card can be then successively inserted into the connector. However, such a waiting period is not favorable for achieving uninterrupted operation.

Hence, an improved card ejecting mechanism driven by a memory alloy wire is needed to eliminate the above mentioned defects of the current card ejecting mechanism.

SUMMARY OF THE INVENTION

Accordingly, an objective of the present invention is to provide a card ejecting mechanism for a card connector which is driven by a memory alloy wire and can permit immediate insertion of a second card into the connector after a card is ejected from the card connector without waiting for the retracted wire to resume its original length.

To fulfill the above mentioned objective, according to one embodiment of the present invention, a card ejecting mechanism for a card connector to eject an electronic card inserted into the connector, includes a memory alloy wire having a first end anchored to a chassis and a second end anchored to a slider reciprocally mounted on a guide. When the wire is applied with an electrical current, the wire retracts to motivate the slider from a first position to a second position. A bracket is fixedly attached with a stud and a coil spring. A lever has a first end drivably engaging with the bracket and a second end drivably engaging with a card ejecting plate. A block is fixedly attached to the guide and located between the coil spring and the stud when the slider is at the first position. A push rod is pivotably mounted to the slider and has a front end engaging with the stud when the slider is at the first position. A leaf spring is also mounted to the slider and exerts a biasing force on the push rod toward the bracket. During movement of the slider from the first position to the second position, the push rod pushes the stud causing the bracket to move from a first position to a second position whereby the lever is pivoted to activate the card ejecting plate to eject a card inserted into the connector. When the slider approaches the second position, the push rod is biased by the block away from the bracket whereby the push rod is disengaged from the stud. At this moment, the coil spring which has been compressed by the bracket, pushes the bracket, the lever and the card ejecting plate back to their original positions so that another electronic card can be immediately inserted into the connector without the waiting for the memory wire to resume its original length.

DETAILED DESCRIPTION OF THE PREFERRED EMBODIMENT

Reference will now be made in detail to the preferred embodiment of the present invention.

Figure 1:
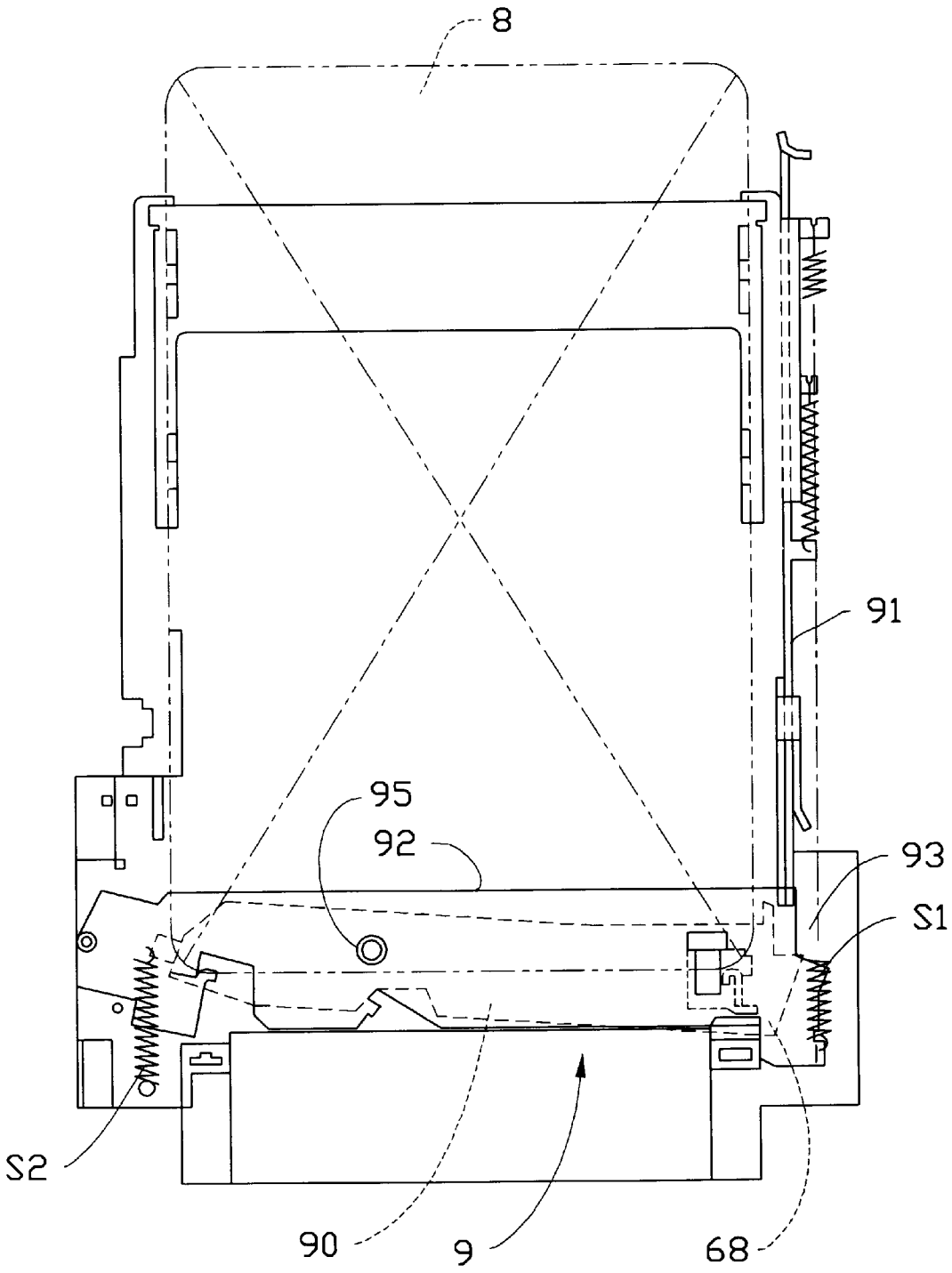
FIG.1 (PRIOR ART)
FIG. 1 is a top view of a card connector in accordance with Japanese Patent Publication No. 8-236203.
Figure 2:
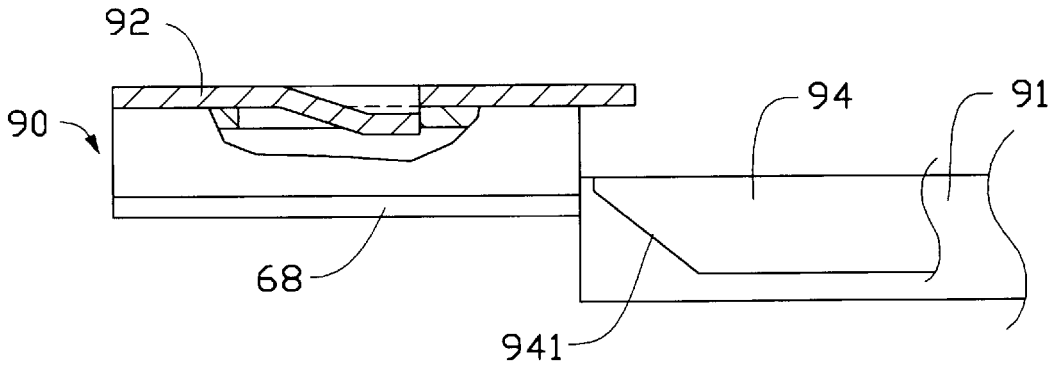
FIG.2 (PRIOR ART)
FIG. 2 is a diagrammatic view showing a relation between a drawer plate, a card ejecting plate and a memory alloy of the card connector of FIG. 1, wherein the wire is at a natural state.
Figure 3:
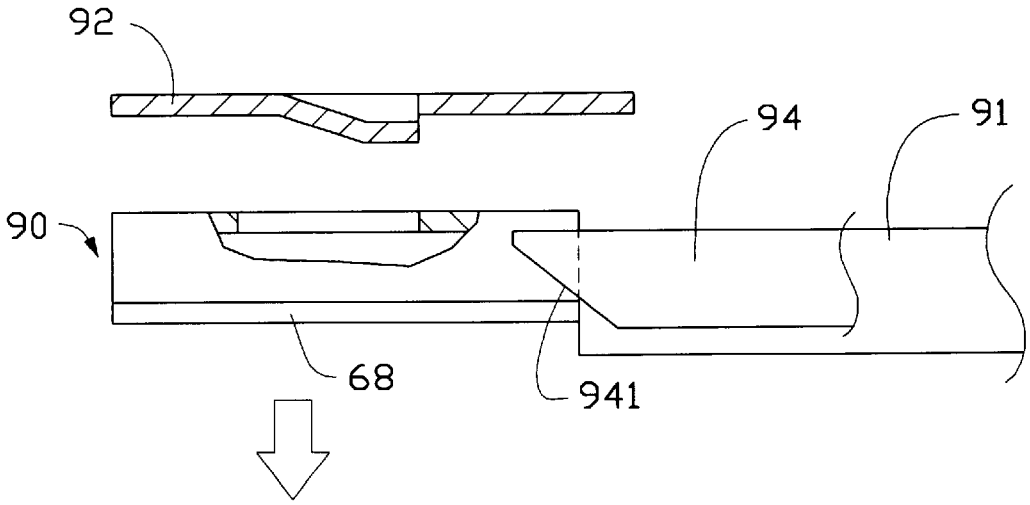
FIG.3 (PRIOR ART)
FIG. 3 is a view similar to FIG. 2 wherein the memory alloy wire is applied with an electrical current to retract and activate the card ejecting plate.
Figure 4:
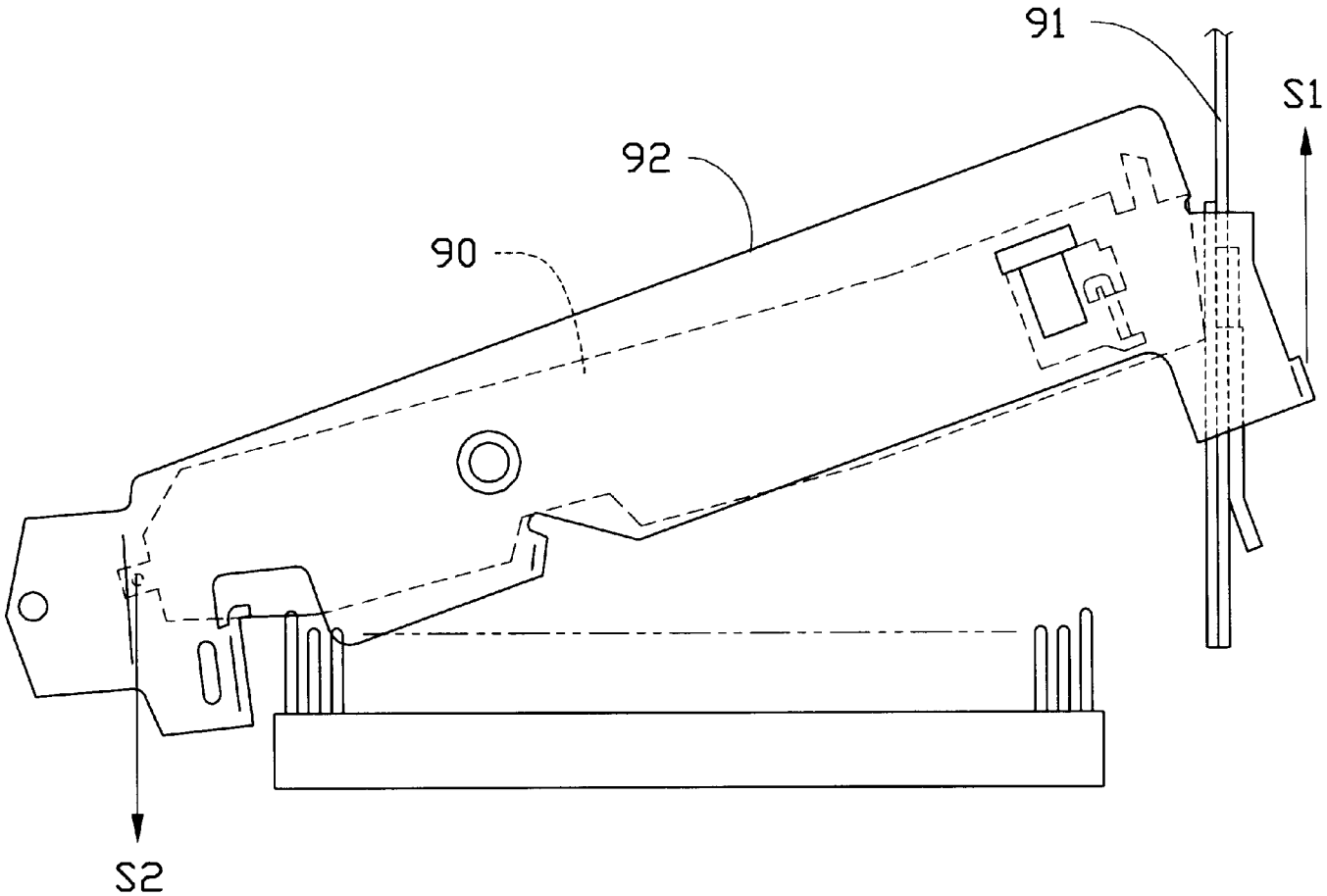
FIG.4 (PRIOR ART)
FIG. 4 is a top view showing that the drawer plate together with the card ejecting plate of the card connector of FIG. 1 is pulled by a spring to eject a card inserted into the connector.
Figure 5:
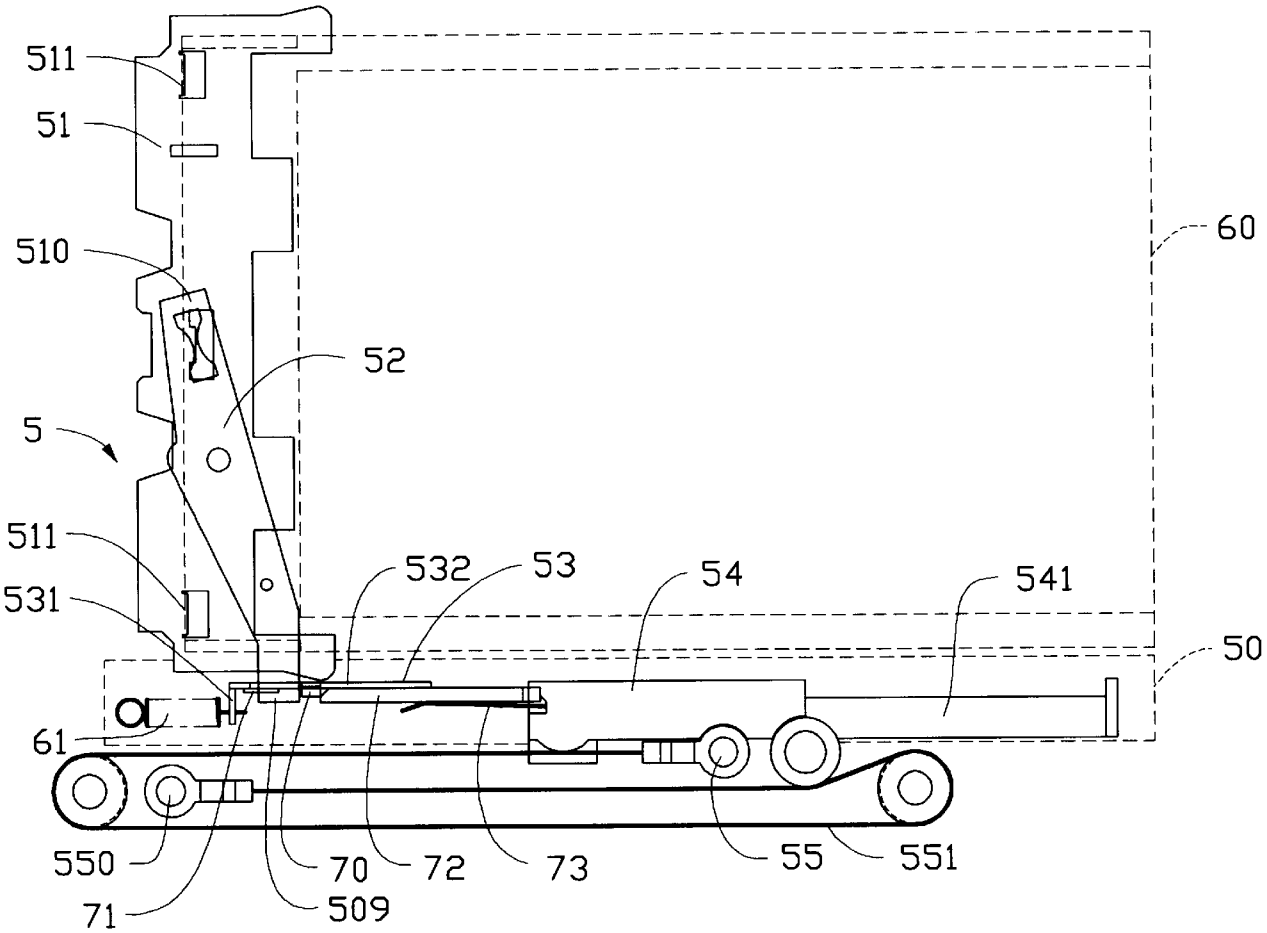
FIG. 5 is a top view of a card connector in accordance with the present invention at a first position.

As shown in FIG. 5, a card connector 1 in accordance with the present invention includes a card ejecting mechanism 5 driven by a memory alloy wire 551. The memory alloy wire 551 has a first end 550 fixedly anchored to a chassis (not shown) and a second end 55 fixed to a slider 54 slidably mounted on a guide 50. A push rod 72 is pivotably mounted to a rear end of the slider 54 and a leaf spring 73 is fixed to the rear end of the slider 54 which exerts a push force on the rod 72 toward an inside of the card connector 1. A handle 541 extends from a front end of the slider 54 whereby the card ejecting mechanism 5 can also be manually driven.

An L-shaped bracket 53 is movably mounted on the guide 50. A coil spring 61 is mounted between a rear base 531 of the bracket 53 and the guide 50. The bracket 53 further has an arm 532 extending forward from the base 531 toward the push rod 72. A stud 70 is fixedly attached to the arm 532 at a middle portion thereof. A block 71 is fixedly attached to the guide 50.

The card ejecting mechanism 5 further has a pivotable lever 52 having a first end 509 drivably connected with the bracket 53 and a second opposite end 510 drivably connected with a card ejecting plate 51 which has card engaging tabs 511. When the first end 509 is pushed rearwards by the bracket 53, the lever 52 pivots to motivate the card ejecting plate 51 forward to eject an inserted card 60.

Figure 8A:
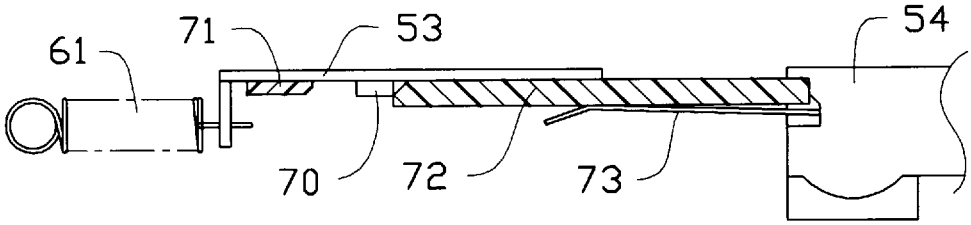
FIG. 8A is an enlarged side view of a portion of a card ejecting mechanism of the card connector of FIG. 5 at the first position.
Figure 9A:
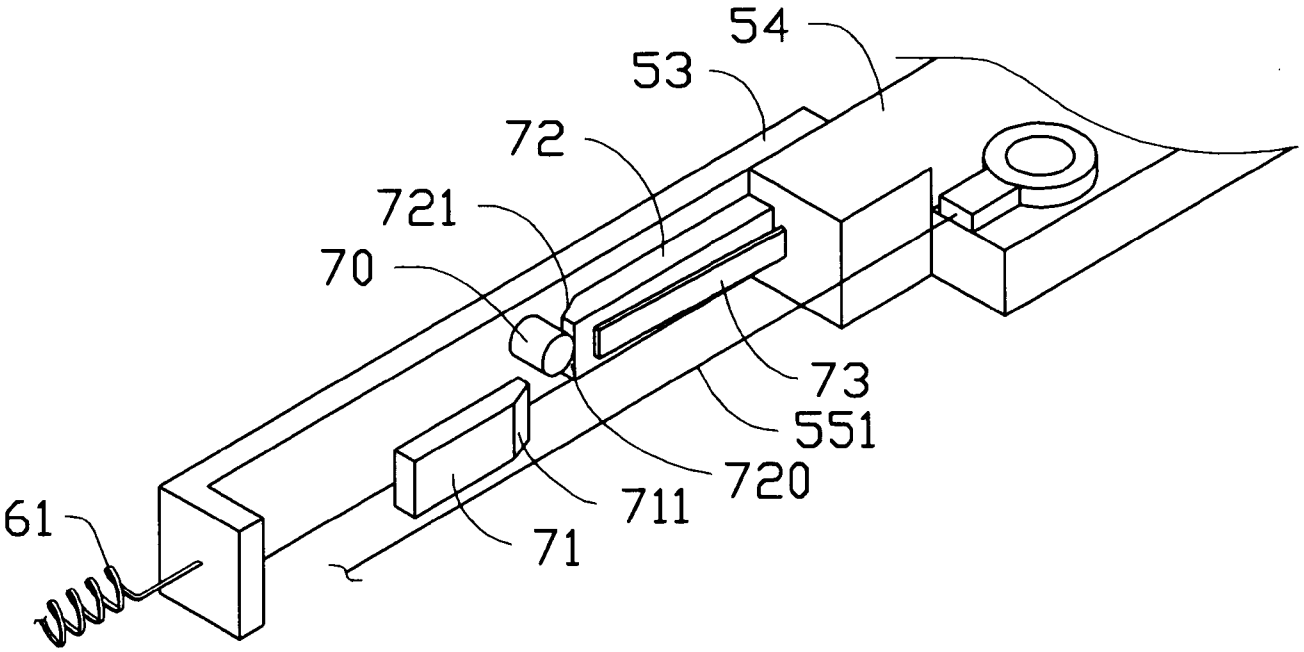
FIG. 9A is an enlarged perspective view of a portion of the card ejecting mechanism at the first position.

Also referring to FIGS. 8A and 9A, which also show the card ejecting mechanism 5 at a first position wherein a card 60 is inserted into the connector 1, the wire 551 is not applied with an electrical current to retract and motivate the slider 54 rearwardly and a rear vertical end 720 of the push rod 72 engages with the stud 70.

Figure 6:
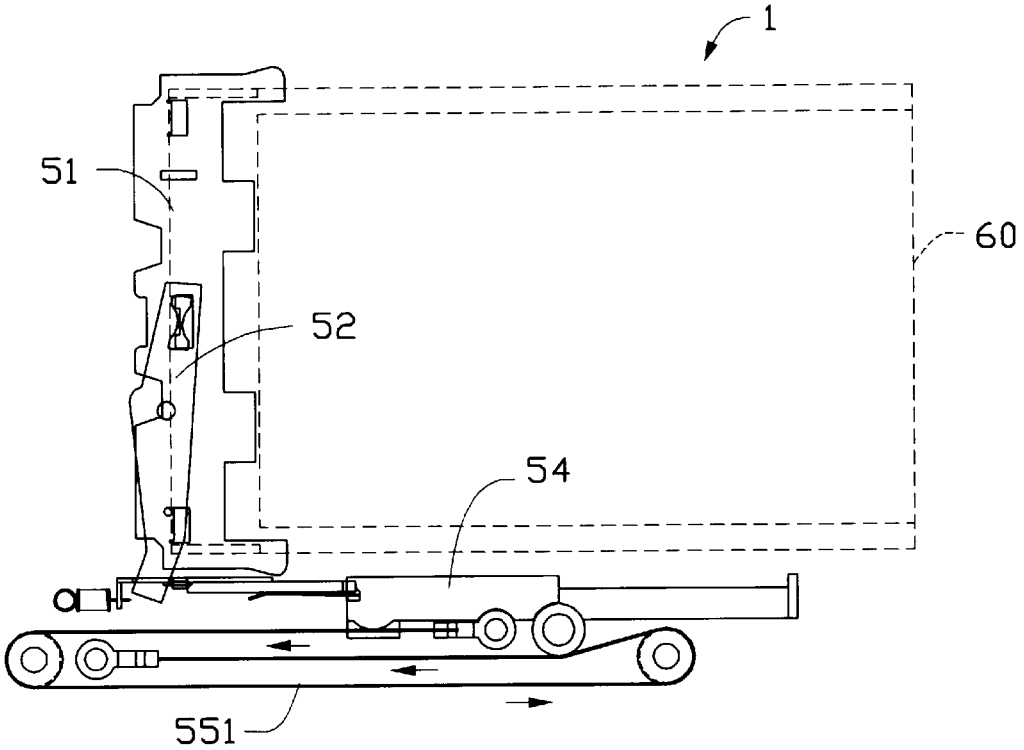
FIG. 6 is a view similar to FIG. 5 showing the card connector at a second position.
Figure 8B:
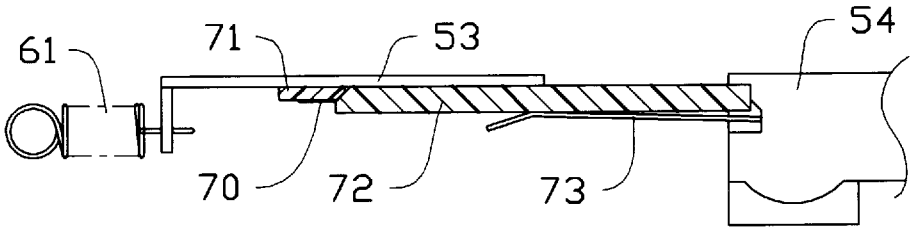
FIG. 8B is a view similar to FIG. 8A showing the mechanism at the second position.
Figure 9C:
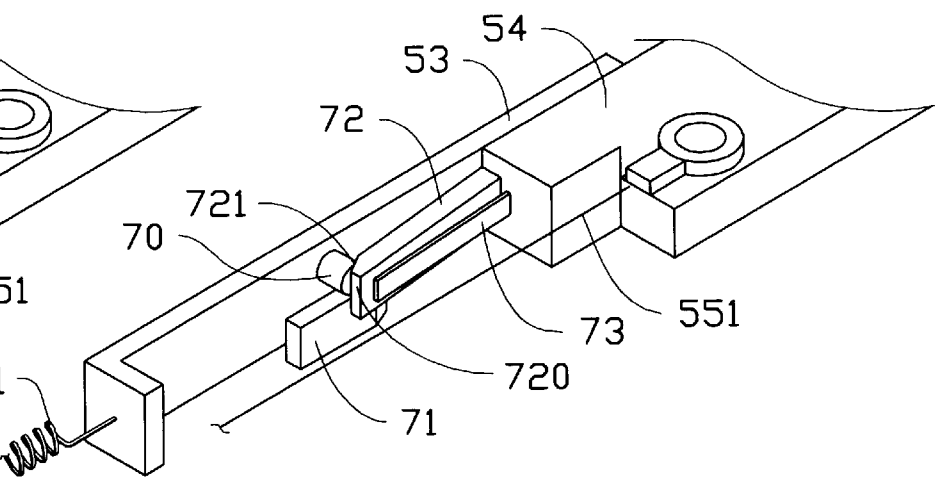
FIG. 9C is a view similar to FIG. 9A showing the mechanism at the third position.
Figure 9B:
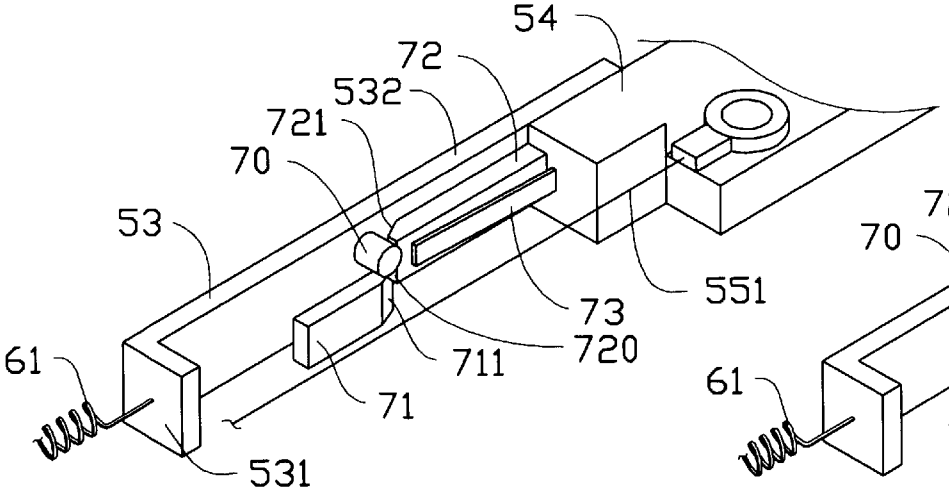
FIG. 9B is a view similar to FIG. 9A showing the mechanism at the second position.

Referring to FIGS. 6, 8B and 9B, when the memory alloy wire 551 is applied with an electrical current, the wire 551 retracts to pull the slider 54 toward a rear end of the guide 50 as indicated by arrows in FIG. 6. The slider 54 is pulled to a position where a lower portion of an inclined face 721 near the rear vertical end 720 of the push rod 72 starts to engage with an upper portion of an inclined face 711 near a front end of the block 71 fixed to the guide 50. Thus, the push rod 72 starts to be biased away from the stud 70.

Figure 7:
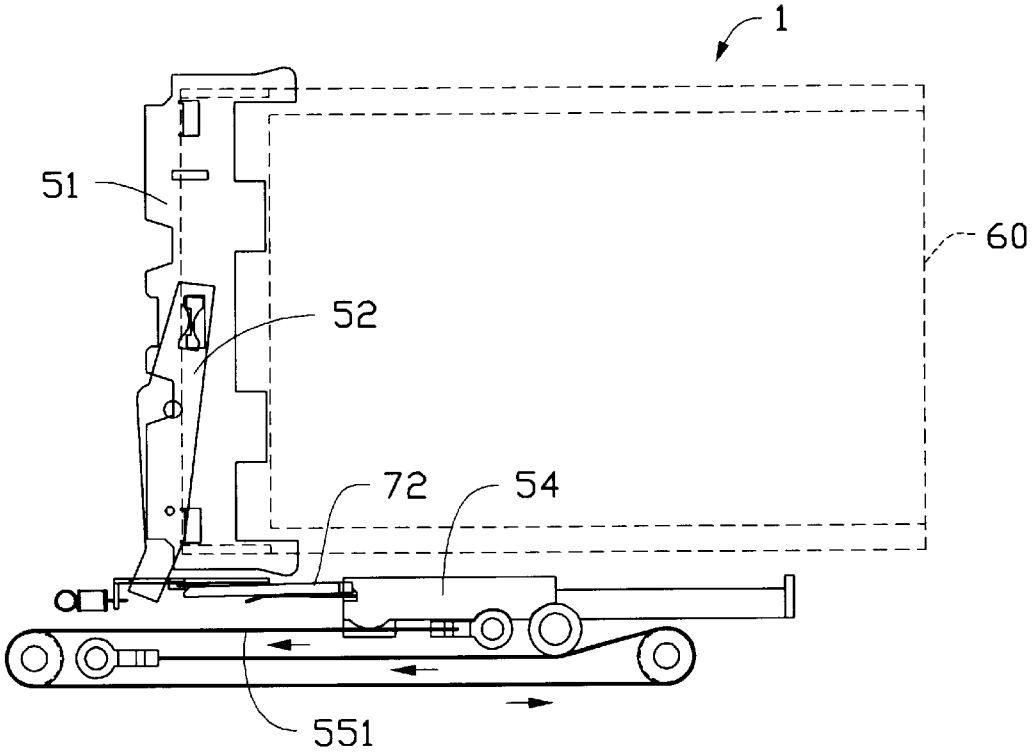
FIG. 7 is a view similar to FIG. 5 showing the card connector at a third position.
Figure 8C:
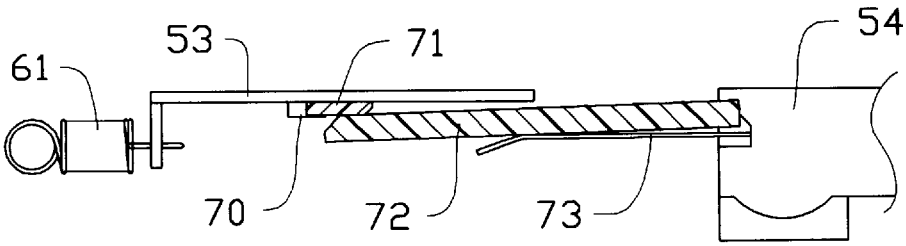
FIG. 8C is a view similar to FIG. 8A showing the mechanism at the third position.

As the memory alloy wire 551 further retracts to a final position as shown in FIGS. 7, 8C and 9C, the push rod 72 is further biased by the block 71 whereby its rear vertical end 720 is totally disengaged from the stud 70. During movement to the final position, the lever 52 is driven by the push rod 72 via the stud 70 and the bracket 53 to pivot and motivate the card ejecting plate 51 forward, thereby fully ejecting the inserted card 60 (for clarity, the lever 52 is not shown in FIGS. 8C and 9C), and the coil spring 61 is compressed by the bracket 53. Once the vertical rear end 720 of the push rod 72 is disengaged from the stud 70, the bracket 53, lever 52 and card ejecting plate 51 return to their original positions as shown in FIG. 5 due to the resilience of the compressed coil spring 61. Thus, a second card can be immediately inserted into the connector 1 without waiting for the memory alloy wire 551 to resume its original length after the electrical current is no longer applied to the wire 551.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

We claim:

1. A mechanism for ejecting an electronic card inserted into a card connector, comprising:

a memory alloy wire having a fixedly anchored first end, and a movable second end;

a card ejecting plate reciprocally mounted on the connector for ejecting a card inserted into the connector;

a lever pivotably mounted to the connector, having a first end drivably connected with the card ejecting plate and a second end;

a guide fixed to the connector;

a force transmitting member drivably connected with the second end of the lever;

a slider reciprocally mounted on the guide and fixedly connected with the second end of the wire wherein when an electrical current is applied to the wire causing the wire to retract, the slider moves from a first position to a second position;

a push rod pivotably mounted to the slider; and a first resilient member exerting a biasing force on the push rod toward the force transmitting member;

wherein when the slider is at the first position, the push rod engages with the force transmitting member, during movement of the slider from the first to the second position, the push rod pushes the force transmitting member causing the lever to pivot, thereby causing the card ejecting plate to move to eject an inserted card, and when the slider reaches the second position, the push rod is disengaged from the force transmitting member.

2. The mechanism in accordance with claim 1 further comprising a second resilient member mounted between the force transmitting member and the guide, the second resilient member being compressed when the slider is moved from the first position to the second position.

3. The mechanism in accordance with claim 2, wherein the force transmitting member is fixedly attached with a stud and the guide is fixedly attached with a block, and wherein at the first position the push rod engages with the stud and at the second position the push rod is biased by the block to disengage from the stud.

4. The mechanism in accordance with claim 3, wherein the push rod and the block have confronting inclined surfaces which engage with each other when the slider is moved from the first position to the second position.

5. The mechanism in accordance with claim 1 further comprising a handle attached to the slider for manually operating the mechanism.

6. The mechanism in accordance with claim 1, wherein the force transmitting member has a generally L-shaped configuration.

7. The mechanism in accordance with claim 3, wherein the block is located between the stud and second resilient member when the slider is located at the first position.

8. The mechanism in accordance with claim 1, wherein the card ejecting plate has two card engaging tabs.

9. A mechanism for ejecting an card received within a connector, comprising:

a card ejecting plate reciprocally mounted on the connector for ejecting the card in the connector;

a lever pivotally mounted on the connector and connected, at a first end thereof, to the card ejecting plate;

a guide fixed to the connector;

a bracket movably mounted to the guide and connected to a second end of the lever;

a slider reciprocally mounted on the guide; and a memory alloy wire connected to the slider; whereby during ejection of the card, the slider is moved rearward by the memory alloy wire and engageably activates the bracket to move rearward, so that the lever is rearward moved at the second end thereof and correspondingly is forward moved at the first end thereof, thus resulting in moving the ejecting plate forward and ejecting the card.

10. The mechanism in accordance with claim 9 further including first means for resuming the lever wherein said first means includes a resilient member mounted between the bracket and the guide to generate a recovery force when the bracket is moved rearward.

11. The mechanism in accordance with claim 9, wherein the guide includes second means for disengaging the bracket from the slider.

12. The mechanism in accordance with claim 11, where a pivotal push rod is positioned at a rear end of the slider for engagement with a stud formed on the bracket, and said push rod can abut against the second means for disengagement from the stud.

* * * * *